United States Patent [19]

Shamlian

[11] 4,136,689

[45] Jan. 30, 1979

[54] CUSTOMIZED MOUTHPIECE RETAINER FOR AN UNDERWATER BREATHING APPARATUS

[75] Inventor: Ralph B. Shamlian, San Francisco, Calif.

[73] Assignee: Farallon Industries, Inc., Belmont, Calif.

[21] Appl. No.: 757,036

[22] Filed: Jan. 5, 1977

Related U.S. Application Data

[60] Continuation of Ser. No. 608,551, Aug. 28, 1975, abandoned, which is a continuation of Ser. No. 488,035, Jul. 12, 1975, abandoned, which is a division of Ser. No. 402,720, Oct. 2, 1973, Pat. No. 3,844,281.

[51] Int. Cl.[2] ..... A62B 7/00

[52] U.S. Cl. ..... 128/147; 128/145 A

[58] Field of Search ..... 128/147, 136, 145 A, 128/294, 138 R, 130, 270; 32/17, 19, 2

[56] References Cited

U.S. PATENT DOCUMENTS

| | | | |
|---|---|---|---|
| 3,124,129 | 3/1964 | Grossberg | 128/136 |
| 3,126,002 | 3/1964 | Owens | 128/136 |
| 3,329,158 | 7/1967 | Geiszler | 128/142 R |
| 3,768,465 | 10/1973 | Helmer | 128/136 |

*Primary Examiner*—Henry J. Recla

*Attorney, Agent, or Firm*—Lowhurst & Aine

[57] ABSTRACT

The retainer portion of the mouthpiece of an underwater breathing apparatus includes at least a portion made of a thermoplastic material. The retainer is customized to the bite of the user by heating the mouthpiece to render the retainer plastic. The retainer, while plastic, is gripped by the teeth of the user to form an impression of the user's bite in the thermoplastic material of the retainer. In one embodiment, the thermoplastic portion of the retainer comprises only a sleeve of thermoplastic material which is affixed over the conventional rubber retaining member. In an alternative embodiment, the thermoplastic retainer is formed as an integral molded portion of the mouthpiece.

2 Claims, 6 Drawing Figures

CUSTOMIZED MOUTHPIECE RETAINER FOR AN UNDERWATER BREATHING APPARATUS

This is a continuation of application Ser. No. 608,551, filed 8/28/75 now abandoned which in turn is a continuation of application Ser. No. 488,035 filed on 7/12/75 now abandoned which in turn is a divisional application Ser. No. 402,720 filed 10/2/73 now U.S. Pat. No. 3,844,281.

BACKGROUND OF THE INVENTION

The present invention relates in general to mouthpieces for underwater breathing apparatus and, more particularly, to an improved method and apparatus for retaining the mouthpiece within the mouth of the user by customizing the retainer means to the bite of the user by means of the use of thermoplastic material.

DESCRIPTION OF THE PRIOR ART

Heretofore, the mouthpiece of an underwater breathing apparatus has been retained within the mouth of the user by means of rubber projections extending outwardly of the flanged lip portion of the mouthpiece. The retainer projections included a flanged free-end portion and an intermediate portion which fits between the teeth and which is gripped between the upper and lower teeth in use. The retaining members are made of rubber and formed as an integrally molded portion of the rubber mouthpiece.

The problem with the prior art retaining members is that they present a relatively small area to the teeth of the user such that a relatively high pressure is transmitted from the retaining member to the one or two teeth which grip each of the retaining members. In cold water, the low temperature of the gums and teeth tends to aggravate the pain produced by the reactive force of the rubber retaining means on the gripping teeth.

Therefore, it is desired to obtain an improved mouthpiece wherein the reactive gripping force exerted on the teeth by the retaining means is distributed more uniformly over the gripping teeth such that the mouthpiece is more comfortable in use.

It is also known from the prior art to make a tooth-protective guard for boxers and other athletes of a thermoplastic material. The thermoplastic guard comprises a curved channel of thermoplastic material which is heated to plastic temperatures and inserted into the mouth and pressed over and around the upper teeth. The user bites gently into the guard, while in the plastic state, and the plastic guard is pressed against the back of the upper teeth such that an impression of the upper teeth is obtained in the guard, whereby the guard is customized to the teeth of the user.

SUMMARY OF THE PRESENT INVENTION

The principal object of the present invention is the provision of an improved mouthpiece for underwater breathing apparatus.

In one feature of the present invention, a blank of a thermoplastic material is formed to be affixed to the mouthpiece of an underwater breathing apparatus as a portion of the retaining means thereof, whereby the retaining structure may be customized to the bite of the user. The mouthpiece is customized to the user by heating the mouthpiece with the affixed thermoplastic member to render the member plastic, inserting the mouthpiece into the mouth of the user and biting down on the heated thermoplastic retainer portion to obtain an impression of the user's bite in the retaining structure, whereby the retainer of the mouthpiece is customized to the bite of the user.

In another feature of the present invention, thermoplastic blanks which are to form a portion of the retaining structure of the mouthpiece are formed as sleeves which fit over the conventional rubber retaining projections of the mouthpiece, whereby a conventional mouthpiece may be customized to the bite of the user.

Other features and advantages of the present invention will become apparent upon a perusal of the following specification taken in connection with the accompanying drawings wherein:

DESCRIPTION OF THE PREFERRED EMBODIMENTS

Figure 1:
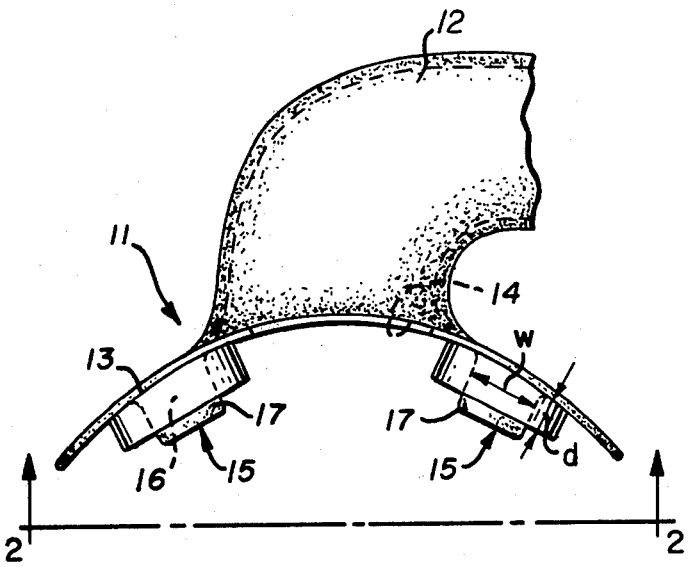
FIG. 1 is a plan view of the mouthpiece portion of an underwater breathing apparatus incorporating features of the present invention.
Figure 2:
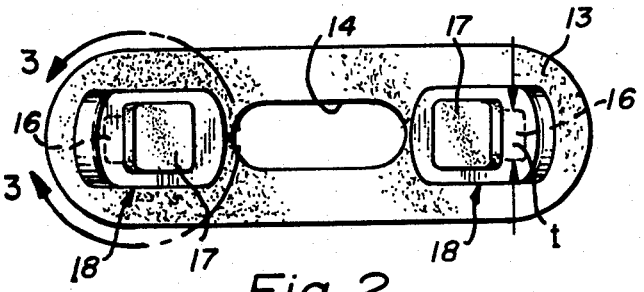
FIG. 2 is an end view of the structure of FIG. 1 taken along line 2—2 in the direction of the arrow.

Referring now to FIGS. 1 and 2, there is shown a conventional mouthpiece structure 11 of an underwater breathing apparatus as modified to incorporate features of the present invention. More particularly, the mouthpiece structure 11, as of one piece molded rubber, includes a breathing tube portion 12 connected in gas communication via additional tubulation, now shown, to a source of air.

That portion of the mouthpiece 11 which is to be retained within the mouth of the user includes a pliable flanged lip portion 13 at the mouthpiece end of the tubulation 12. The flanged lip portion 13 includes a central breathing hole 14 connected in gas communication with the breathing tube 12.

A pair of retaining members 15, as of rubber, project outwardly from the concave face of the flange 13 to be clenched between the teeth of the user for retaining the breathing tube 12 within the mouth of the user. The retaining members 15 each include a central body portion 16 extending outwardly from the flange 13 to a flanged free-end portion 17. In a typical example, the central body portion 16 has a thickness t of 0.20", a width w of 0.50" and a depth of 0.20". The flange portion 17 has approximately equal width and thickness as of 0.50" each and a depth as of 0.10".

Figure 3:
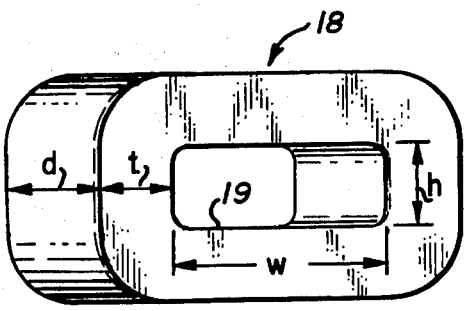
FIG. 3 is an enlarged perspective view of a portion of the structure of FIG. 2 delineated by line 3—3 and depicting a thermoplastic blank of the present invention.
Figure 4:
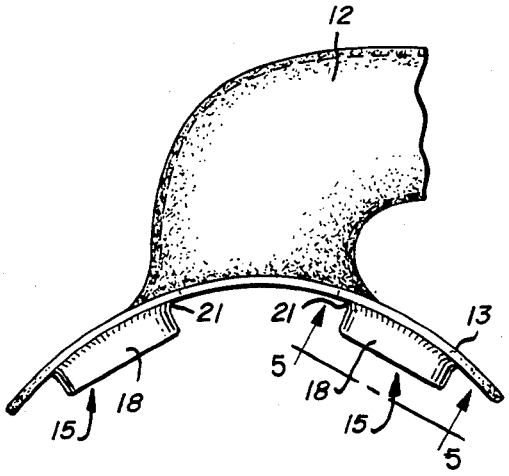
FIG. 4 is a view similar to that of FIG. 1 depicting an alternative embodiment of the present invention.

A thermoplastic sleeve 18, as more fully shown in FIG. 3, is affixed over each of the retaining projections 15. In a typical example the sleeve 18 is made of a suitable thermoplastic material such as ethylene vinyl acetate. Such a material is commercially available from Dupont under their trademark Alathon. In a typical example, the sleeve 18 has a depth d of 0.35" and a wall thickness t of 0.20". The central opening 19 in the sleeve 18, which is to receive the main body 16 of the retaning projection 15, has a height h of 0.15" and a width w of 0.45".

In use, the thermoplastic blank sleeves 18 are threaded over the respective central body portions 16 of the retaining projections 15 and captured to flange 13 via the flanged end portions 17 of the retaining projections 15.

The mouthpiece 11 is heated in a pot of boiling water for 50 seconds to render the blank sleeve portions 18 thermoplastic. The mouthpiece 11 is then removed from the boiling water and inserted for one second into cold water. The mouthpiece 11 is placed immediately in the mouth of the user with the flange portion 13 disposed between the lips and the teeth of the user and with the concave face of the flange 13 abutting the outside surfaces of the front and side teeth.

The thermoplastic blank sleeve portions 18 are located inbetween the upper and lower teeth in the regions of the canine and first pre-molar teeth, i.e., between several top and bottom teeth on each side of the mouth behind the front teeth. As the teeth are clenched onto the thermoplastic sleeve 18 they make an impression in the sleeve, such impression indenting the sleeve substantially to the substantially less plastic central body portion 16, or core or tab, of the retaining projection 15.

The central body portions 16 of the projections 15 are dimensioned of the proper thickness to ensure that the spacing between the users teeth, as closed on the retainer bodies 16, is sufficient to permit breathing through the front teeth and breathing hole 14. As the thermoplastic sleeve 18 deforms to provide the impression, it elongates to extend into the region of adjacent teeth toward the front and rear of the mouth. In this manner, substantially increased tooth bearing area is obtained for the composite retaining structure. The elongation of the thermoplastic sleeve 18 is not sufficient to interfere with or otherwise cut off the breathing opening 14.

The advantages of the customized retainer portion of the mouthpiece 11 are that the load bearing reactive forces exerted on the teeth by the retaining structure are spread out over more teeth. In addition, the forces are uniformly distributed over the teeth which bear on the retaining structure to provide a much more comfortable grip especially when diving in cold water.

The thermoplastic sleeves 18 are adapted to conventional mouthpieces 11 which are presently in use. The user merely acquires the sleeves 18 and presses them into position on the existing retaining structures 15.

Figure 5:
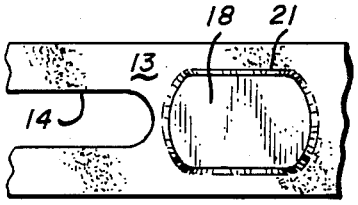
FIG. 5 is a fragmentary view of a portion of the structure of FIG. 4 taken along line 5—5 in the direction of the arrows.
Figure 6:
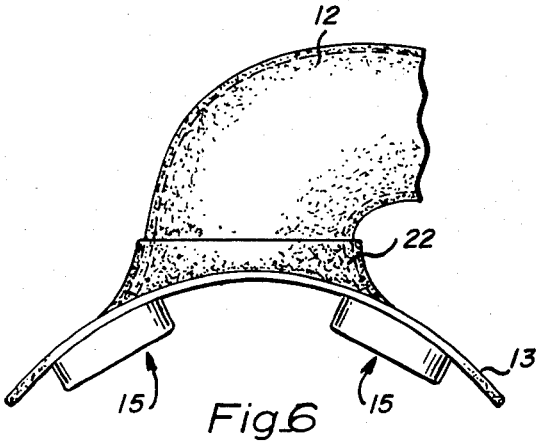
FIG. 6 is a view similar to that of FIGS. 1 and 4 depicting an alternative embodiment of the present invention.

In an alternative embodiment of the present invention (see FIGS. 5 and 6), the retaining projections 15 are eliminated and the thermoplastic blank structures 18, which may be solid or which may include the rubber cores 16, are affixed as by molding or bonding at 21 to the flange 13. In another alternative embodiment (see FIG. 6), the flange 13 and retaining structures 15 are integrally molded as one piece of thermoplastic material which is bonded or otherwise affixed to the breathing tube 12, as by sealing flange 22.

The mouthpiece of the present invention may be employed to advantage with any type of underwater breathing apparatus such as a regulator, snorkel, etc.

What is claimed is:

1. A retainer for the mouthpiece of an underwater breathing apparatus of the type having a pliable flange extending outwardly from the end of a breathing tube, such flange to be received between the lips and the frontal surface of the user's teeth and having a pair of spaced apart projections extending outwardly from the flange on opposite sides of the breathing tube, said retainer including means shaped and dimensioned for gripping between the user's upper and lower teeth essentially only on either opposite side of the central front teeth and including means adapted to be mounted over either projection on the mouthpiece, whereby when a retainer is mounted on each projection, the mouthpiece can be held in the user's mouth with the upper and lower teeth of the user spaced apart to facilitate breathing through the breathing tube, said retainer having a surface, when mounted on each projection and the mouthpiece positioned in the mouth of a user, exposed to the bite of the user, said retainer being made of a material which is thermoplastic at an elevated temperature compatible with use within the mouth of the user and which is moldable while in a thermoplastic state by the bite of the user so as to flow to form an impression of the bite of the user in the material upon cooling thereof, whereby each retainer of the mouthpiece can be customized to the bite of the individual user.

2. A retainer for the mouthpiece of an underwater breathing apparatus of the type having a pliable flange extending outwardly from the end of a breathing tube, such flange to be received between the lips and the frontal surface of the user's teeth, a pair of spaced apart retainer mounting areas on the flange on opposite sides of the breathing tube, said retainer including means shaped and dimensioned for gripping between the user's upper and lower teeth essentially only on either side of the central front teeth and including means adapted to be mounted on either retainer mounting area of the mouthpiece, whereby when a retainer is mounted on each retainer mounting area, the mouthpiece can be held in the user's mouth with the upper and lower teeth of the user spaced apart to facilitate breathing through the breathing tube, said retainer having a surface, when mounted on each retainer mounting area and the mouthpiece positioned in the mouth of a user, exposed to the bite of the user, said retainer being made of a material which is thermoplastic at an elevated temperature compatible with use within the mouth of the user and which is moldable while in a thermoplastic state by the bite of the user so as to flow to form an impression of the bite of the user in the material upon cooling thereof, whereby each retainer of the mouthpiece can be customized to the bite of the individual user.

* * * * *